US008556449B1

(12) United States Patent
Matys

(10) Patent No.: US 8,556,449 B1
(45) Date of Patent: Oct. 15, 2013

(54) COMBINED FLASHLIGHT AND LANTERN

(76) Inventor: Adam J. Matys, Amherst, NY (US)

( * ) Notice: Subject to any disclaimer, the term of this patent is extended or adjusted under 35 U.S.C. 154(b) by 227 days.

(21) Appl. No.: 13/278,523

(22) Filed: Oct. 21, 2011

(51) Int. Cl.
*F21L 4/00* (2006.01)

(52) U.S. Cl.
USPC ..... 362/188; 362/184; 362/208

(58) Field of Classification Search
USPC ..... 362/157.184, 188, 208
See application file for complete search history.

(56) References Cited

U.S. PATENT DOCUMENTS

| | | | | |
|---|---|---|---|---|
| 5,412,548 | A | 5/1995 | Yee | |
| 5,440,465 | A | 8/1995 | Hasness | |
| 5,570,948 | A | 11/1996 | Menke et al. | |
| 5,893,629 | A | 4/1999 | Gubernick | |
| 6,004,008 | A | 12/1999 | Lai | |
| 6,206,541 | B1 * | 3/2001 | Landamia | 362/184 |
| 7,819,546 | B1 * | 10/2010 | Kazmerowski et al. | 362/184 |
| 2004/0190288 | A1 * | 9/2004 | Hsu | 362/208 |
| 2006/0034074 | A1 * | 2/2006 | Ko | 362/184 |
| 2006/0221603 | A1 * | 10/2006 | Zazzara et al. | 362/187 |

OTHER PUBLICATIONS

Amazon.com. Eureka! Glide 51 Lantern/Flashlight. http://www.amazon.com/s/ref=nb_sb_noss?url=search-alias%3Daps&field-keywords=Eurekal+Glide+51+Lantern%2FFlashlight&x=0&y=0.

* cited by examiner

*Primary Examiner* — Stephen F Husar
*Assistant Examiner* — James Cranson, Jr.
(74) *Attorney, Agent, or Firm* — Montgomery Patent & Design; Robert C. Montgomery

(57) ABSTRACT

A combined flashlight and lantern which provides multiple configurations combining features of a flashlight and a lantern, further comprising a flashlight housing similar to a conventional flashlight. The apparatus further includes a lantern assembly extendible from a lower end of the housing such that the apparatus can be placed on a horizontal surface and the lantern end withdrawn from the housing to provide a lantern function. The lantern assembly further includes a multi-position switch for cycling through various lighting functions. When the lantern assembly is retracted, a flashlight switch allows the apparatus to function as a high-power spot beam flashlight. A user can actuate both the flashlight switch and lantern switch to operate both functions simultaneously.

15 Claims, 7 Drawing Sheets

COMBINED FLASHLIGHT AND LANTERN

RELATED APPLICATIONS

There are no current co-pending applications related to the current application.

FIELD OF THE INVENTION

The present invention relates generally to a flashlight convertible to a lantern, and in particular, to a flashlight convertible to a lantern and having a range of operating modes.

BACKGROUND OF THE INVENTION

The common flashlight can be found in almost every tool box, car trunk, or kitchen drawer. Flashlights are perfect for producing a high intensity beam to provide temporary lighting, supplemental lighting or emergency lighting in a portable manner. However, these beams are typically spot style beams which produce high intensity lighting levels in a small area.

As such, flashlights are unsuitable for use in producing a broader flood style of illumination that is often desired at campsites or in dark rooms where just general overall illumination is needed. This type of illumination is usually provided by a lantern which produces a broad lighting path over a 360° area. When both functions are desired, the user is often forced to carry both a flashlight and lantern to produce the desired lighting patterns. Unfortunately this adds to increased costs and more importantly increased weight which is often a critical factor while hiking or camping.

Various attempts have been made to provide multi-function portable lighting devices. Examples of these attempts can be seen by reference to several U.S. patents, for example U.S. Pat. No. 5,412,548; U.S. Pat. No. 5,440,465; U.S. Pat. No. 5,570,948; U.S. Pat. No. 5,893,629; and U.S. Pat. No. 6,004,008. However, none of these designs are similar to the present invention.

While these apparatuses fulfill their respective, particular objectives, each of these references suffer from one (1) or more disadvantages. Many such apparatuses do not provide multiple lighting functions that can function independently and simultaneously. Also, many such apparatuses are unnecessarily bulky or complex and as a result are difficult and unintuitive to operate. Furthermore, many such apparatuses do not provide a sufficiently wide range of settings that can be utilized to accommodate a wide enough range of uses, such as spot illumination, room illumination, emergency indication, soft light usage, and the like. Accordingly, there exists a need for a means by which an apparatus can provide benefits of flashlights and also produce a range of flood style lighting patterns in a simple manner and without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a simple, small portable lighting device that provides a wide range of illuminating functions. Thus, the object of the present invention is to solve the aforementioned disadvantages and provide for this need.

To achieve the above objectives, it is an object of the present invention to comprise a combined flashlight and lantern that provides a handheld light source combining the functions of a flashlight and a lantern to selectively provide unidirectional or omni-directional illumination. The apparatus includes a flashlight and an extendable lantern slidably positioned within the flashlight.

Another object of the present invention is to comprise the flashlight of common features including an internal lamp, a transparent lens portion that protects and reflects illumination from the lamp, a knurled exterior for ease of gripping, a replaceable battery, and an ON/OFF switch.

Yet still another object of the present invention is to house and removably secure the lantern within a barrel of the flashlight using a threading attachment. The lantern can further be unscrewed in order to enable the lantern to slide into or out from the barrel to protrude from an end of the flashlight opposite the internal lamp.

Yet still another object of the present invention is to comprise the top portion of the lantern with a knurled grasping surface to facilitate manipulation of the lantern.

Yet still another object of the present invention is to provide a digit-operated pushbutton within an exterior top of the lantern which provides the user with a selectable means to control a pair of lantern lamps located within the interior of the lantern.

Yet still another object of the present invention is to comprise a plurality of electrical conductive contact indentations within an interior of the barrel of the flashlight. The contact indentations are aligned with a plurality of spring-loaded ball bearings affixed to an exterior of the lantern. The ball bearings engage the contact indentations in order to provide a plurality of discrete secured positions for the lantern at differing amounts of extension from the barrel while enabling electrical current from the battery to power the pair of lantern lamps.

Yet still another object of the present invention is to comprise internal circuitry that causes the lantern to cycle through a plurality of settings when the pushbutton is actuated, thereby providing a plurality of lantern-style omni-directional illuminating settings if the lantern is extended. In a preferred embodiment, the first lamp is an amber light and the second light is a white light, with the settings including a first lamp low-light setting, a second lamp setting, a full-powered first lamp setting, a flashing second lamp setting, and a deactivated setting.

Yet still another object of the present invention is to provide a method of utilizing the device that provides a unique means of acquiring the apparatus, replacing or adding batteries as desired, depressing the flashlight switch to illuminate the flashlight lamp, placing the apparatus upright on a level surface with the lens portion against said level surface, pulling the lantern upwards such that the ball bearings slide engage respective contact indentations, utilizing the lantern switch to control the lantern lamps, pushing the lantern into the barrel, and engaging the threaded attachment to secure the lantern to the barrel.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
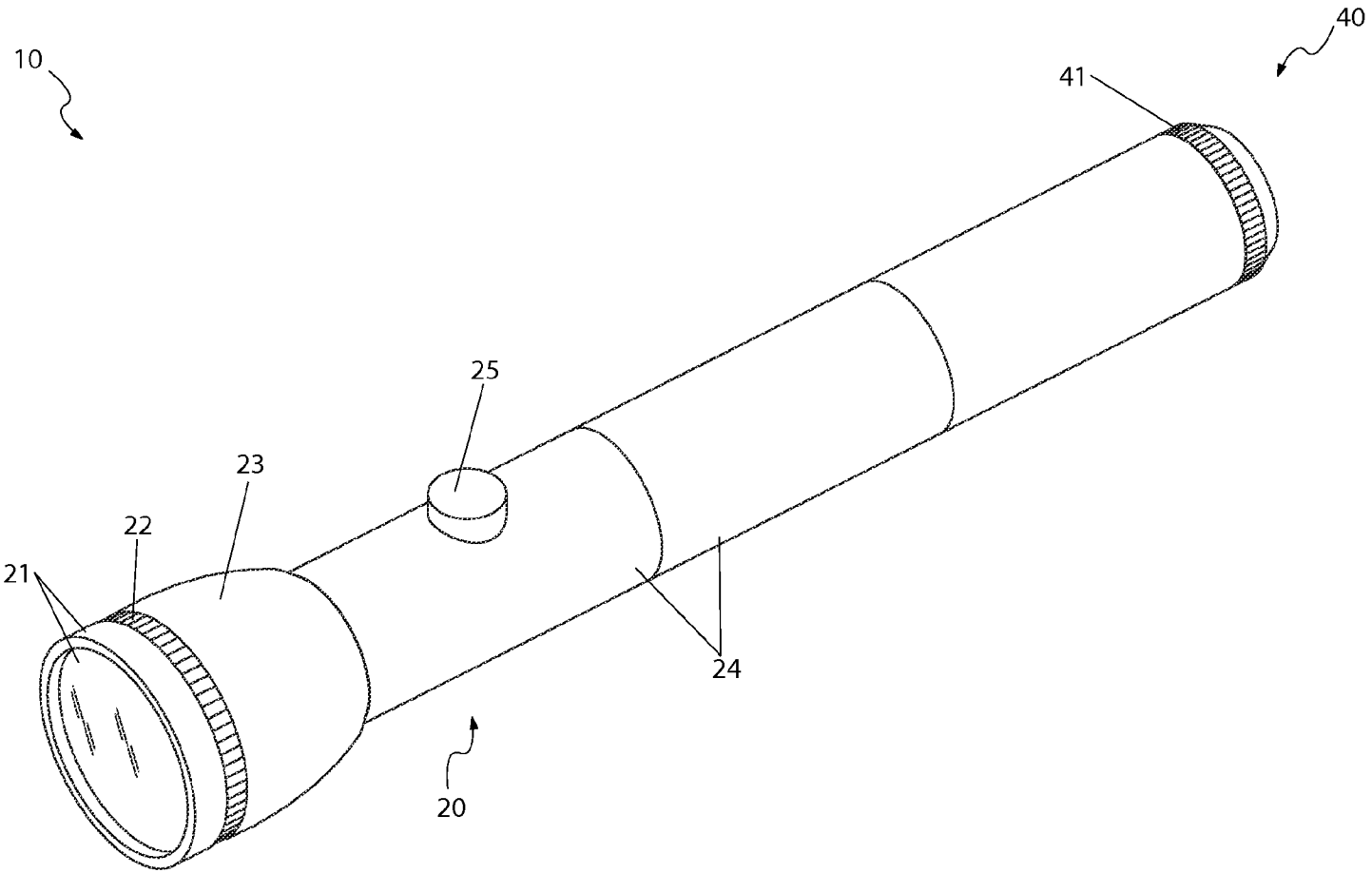
FIG. 1 is a perspective view of a combined flashlight and lantern 10, according to a preferred embodiment of the present invention.

10 combined flashlight and lantern
20 flashlight
21 lens portion
22 lens ring
23 head
24 barrel
25 flashlight switch
26 flashlight lamp
27 contact indentation
28 indentation routing layer
29 barrel interior portion
30 battery
35 wiring
36*a* first threaded attachment
36*b* second threaded attachment
40 lantern
41 tail cap
42 lantern structure
43 interior lantern structure
44 lantern switch
45 first lantern lamp
46 second lantern lamp
47 frame
48 ball bearing
49 spring

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a combined flashlight and lantern (herein described as the "apparatus") 10, which provides a handheld light source to a desired area as needed. The apparatus 10 combines the functions of a flashlight 20 and a lantern 40. The flashlight 20 creates a unidirectional illumination and the lantern 40 creates an omni-directional illumination.

Figure 2:
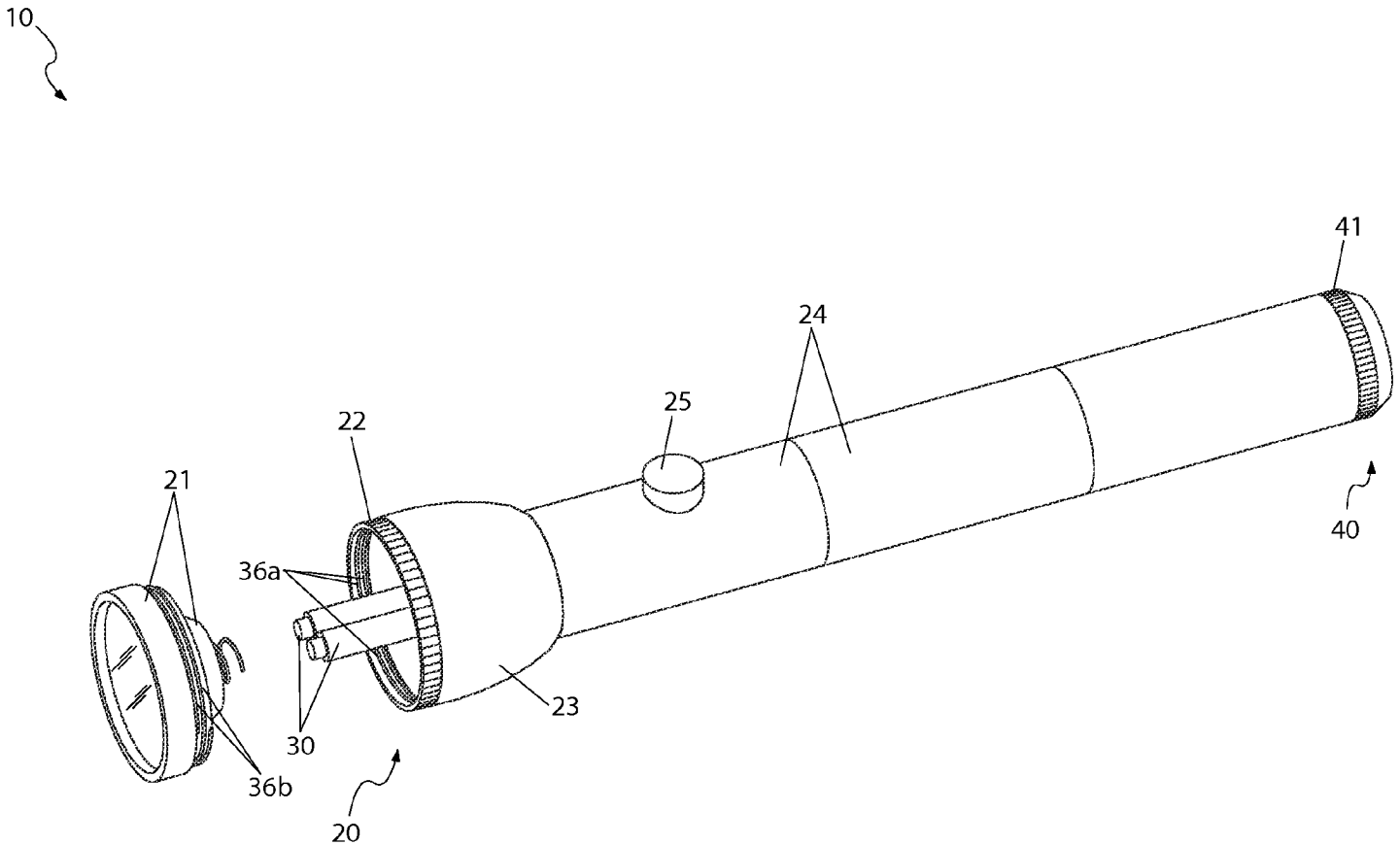
FIG. 2 is another perspective view of the combined flashlight and lantern 10 depicting an exploded flashlight 20, according to a preferred embodiment of the present invention.

Referring now to FIG. 1, a perspective view of the apparatus 10 and FIG. 2, another perspective view of the apparatus 10 depicting an open flashlight 20, according to the preferred embodiment of the present invention, are disclosed. As abovementioned the apparatus 10 comprises a flashlight 20 and an extendable lantern 40 slidably positioned within the flashlight 20. The flashlight 20 comprises a generally cylindrical body fabricated from a stainless steel or similar material and the lantern 40 comprises a generally cylindrical body fabricated from a durable transparent plastic or similar material. The apparatus 10 measures approximately nine (9) inches in length when the lantern 40 is collapsed and twelve (12) inches when said lantern 40 is extended.

A distal portion of the apparatus 10 comprises the flashlight 20 which further comprises a lens portion 21 and a head 23. The lens portion 21 includes common features such as a transparent glass or plastic upper surface and a reflective inner surface which protects and reflects an illumination produced from an internal flashlight lamp 26, respectively. The lens portion 23 is attached to the hollow cup-shaped head 23 via a first threaded attachment 36*a* which is integrally molded to an exterior surface of the lens portion 21 and an interior upper surface of the head 23. A knurled lens ring 22 is located radially along an exterior upper surface of the head 23 to provide a gripping surface for a user to grasp during removal of the lens portion 21. The lens portion 21 is removed from the head 23 to provide access to a plurality of batteries 30 which are housed within a tubular barrel 24. The barrel 24 is an extension of the head 23 and encompasses internal electrical components and the lantern 40. The barrel 24 is depicted herein as including a knurled exterior surface which preferably extends radially about said barrel 24 to provide an improved gripping surface.

Figure 6:
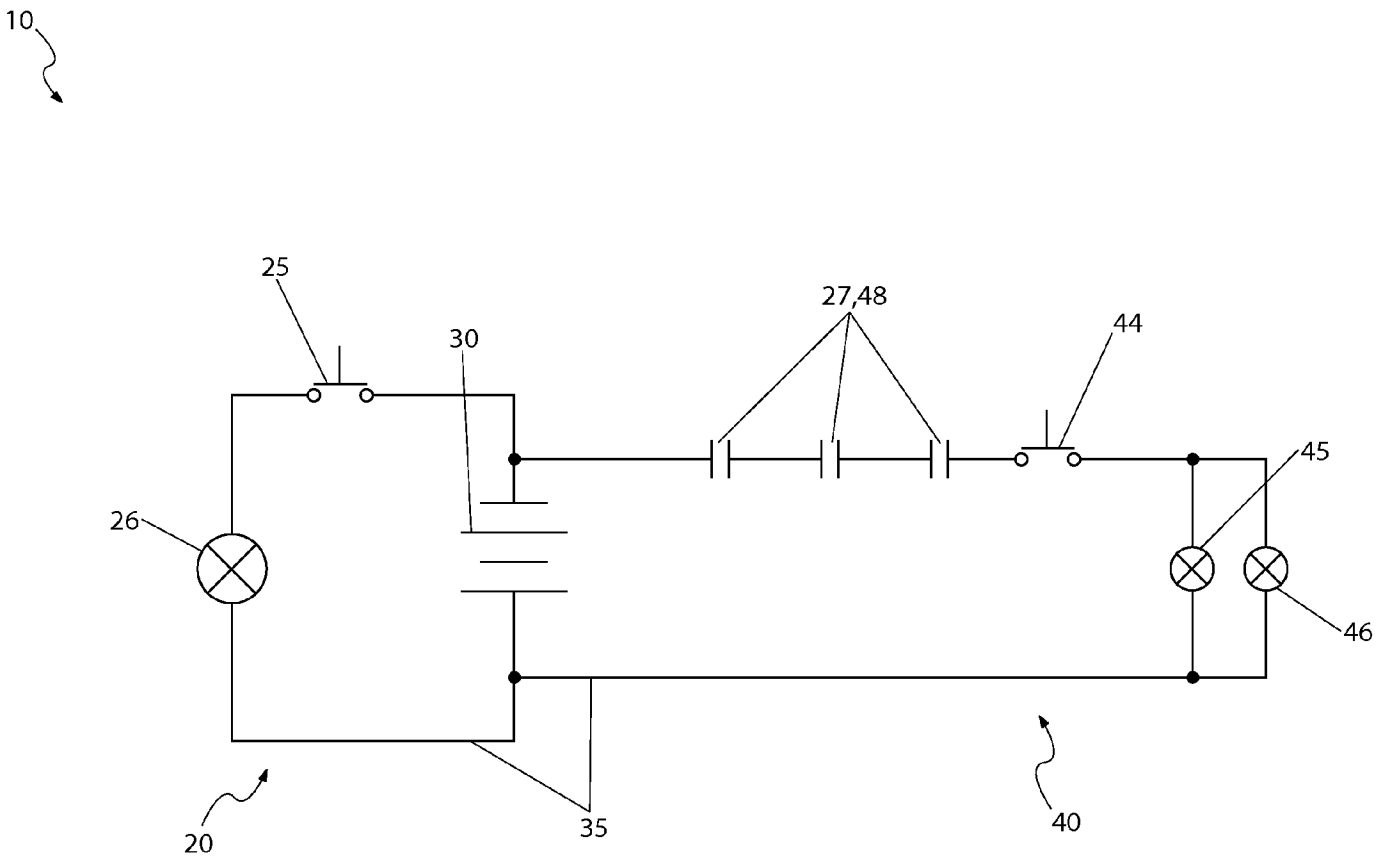

The flashlight lamp 26 within the lens portions 21 is activated or deactivated with a flashlight switch 25 (also see FIG. 6). The flashlight switch 25 is preferably a common dual position pushbutton located on an upper surface of the barrel 24, yet other devices and positions may be utilized without limiting the scope of the apparatus 10.

Figure 3:
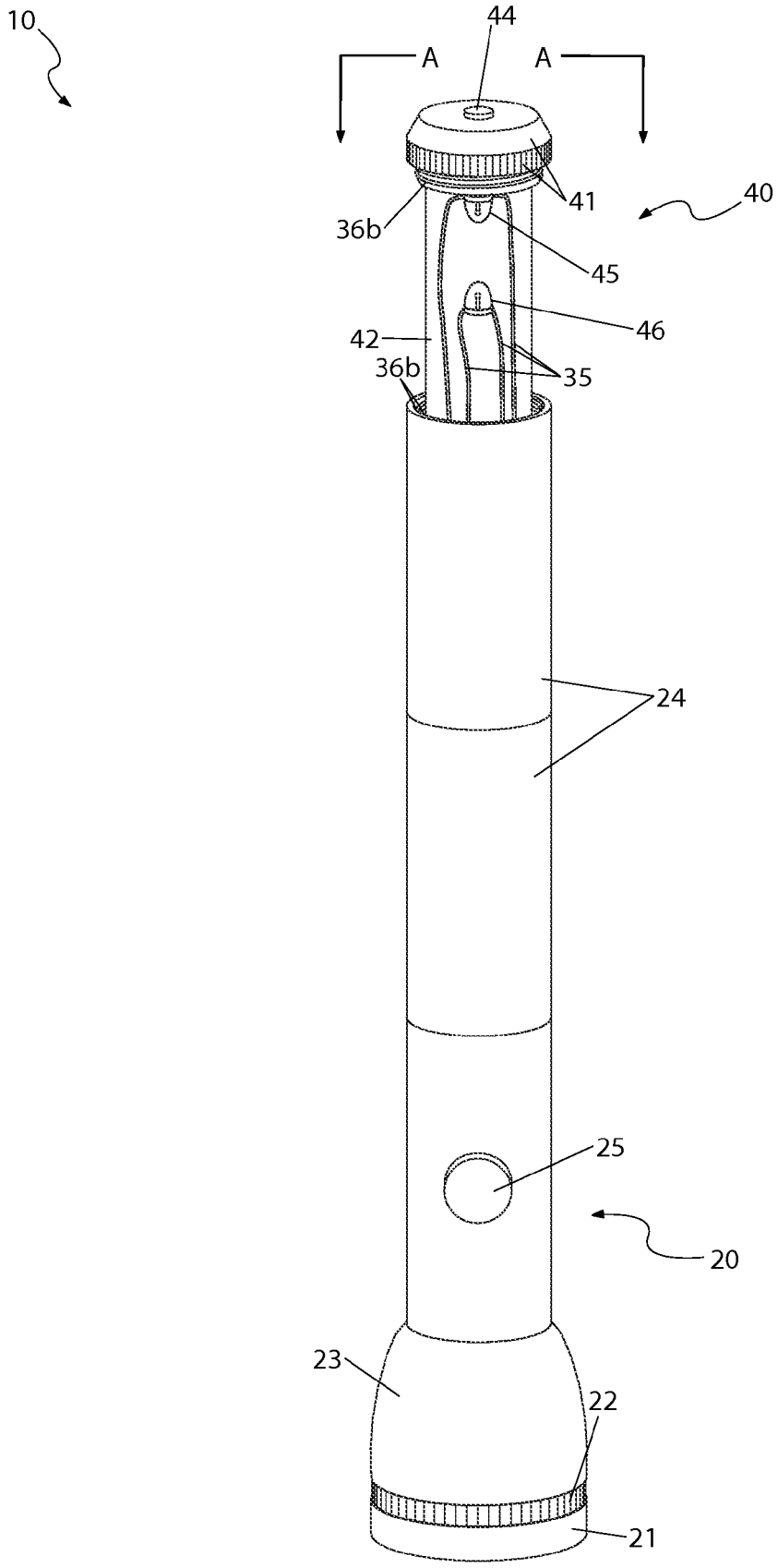
FIG. 3 is yet another perspective view of the combined flashlight and lantern 10 depicting an open lantern 40, according to a preferred embodiment of the present invention.

Referring now to FIG. 3, yet another perspective view of the apparatus 10 depicting an open lantern 40, according to the preferred embodiment of the present invention, is disclosed. The lantern 40 is partially removed from a proximal end of the barrel 40 via a second threading attachment 36*b* which is located on an interior upper surface of said barrel 40 and an exterior upper surface of said lantern 40. The lantern 40 comprises a tubular transparent lantern structure 42. The lantern structure 42 measures approximately four (4) to five (5) inches in length. A top portion of the lantern structure 42 includes an integrally molded tail cap 41 which provides a knurled grasping surface to enable the user to engage or disengage said lantern 40 from the barrel 24. A top surface of the tail cap 41 comprises a lantern switch 44 which provides a digit-operated pushbutton device to manipulate a pair of lantern lamps 45, 46 located within the interior lantern structure 43. The lantern 40 also comprises an internal sliding system which electrically interconnects the lantern switch 44 and the lantern lamps 45, 46 to the batteries 30 (see FIGS. 4 through 5*b*).

Figure 4:
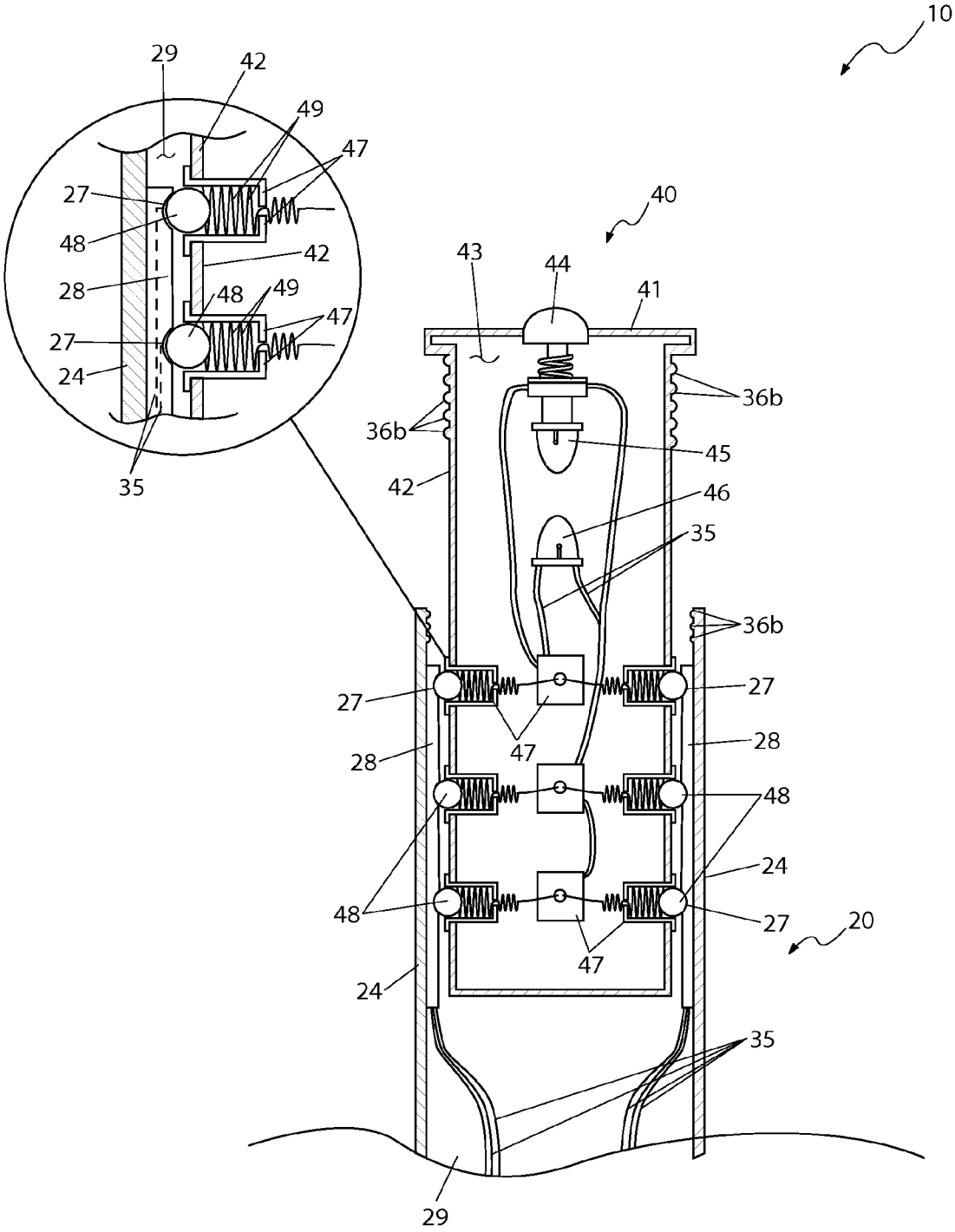
FIG. 4 is a section view of the combined flashlight and lantern 10 taken along line A-A (see FIG. 3), according to a preferred embodiment of the present invention.
Figure 5A:
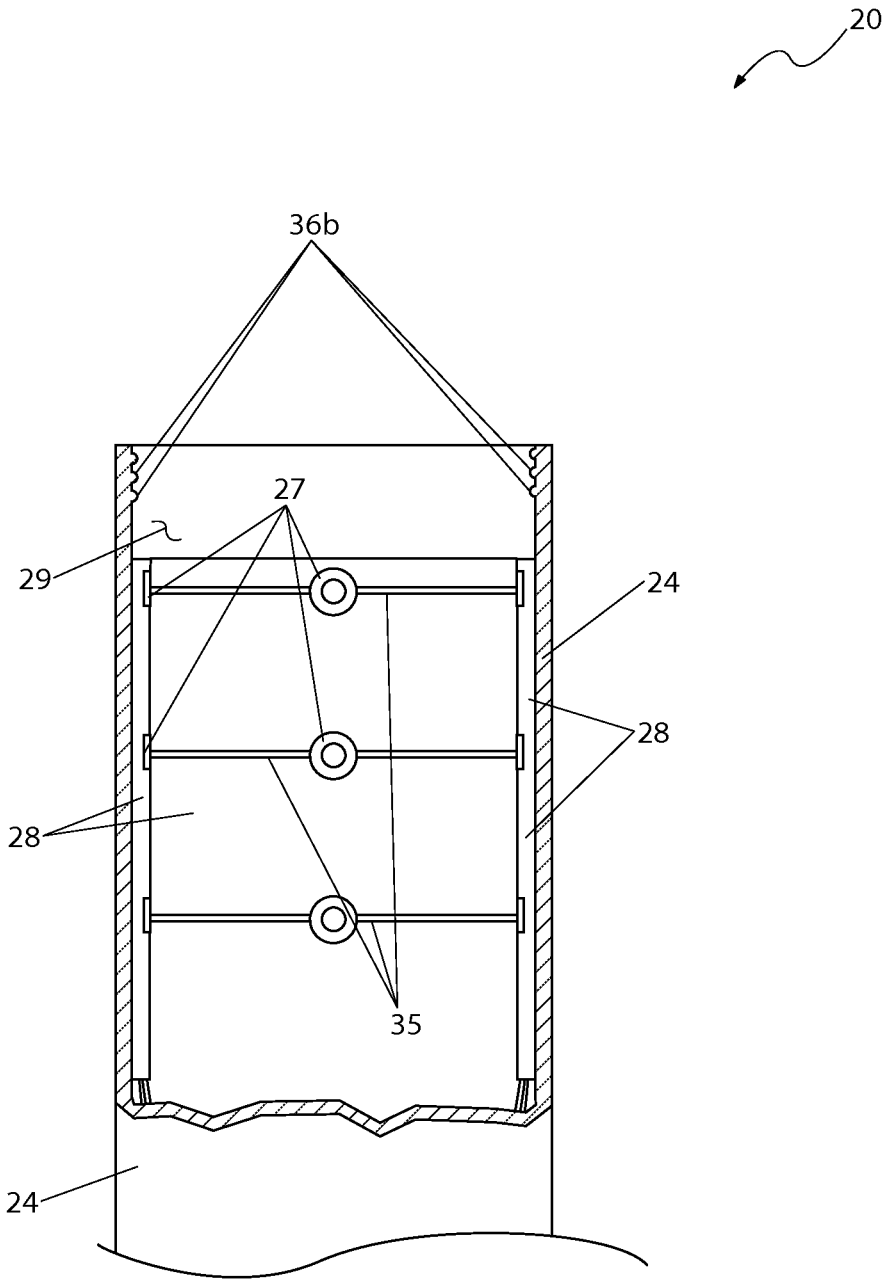
FIG. 5*a* is a cut-away view of an upper portion of the flashlight 20, according to a preferred embodiment of the present invention.
Figure 5B:
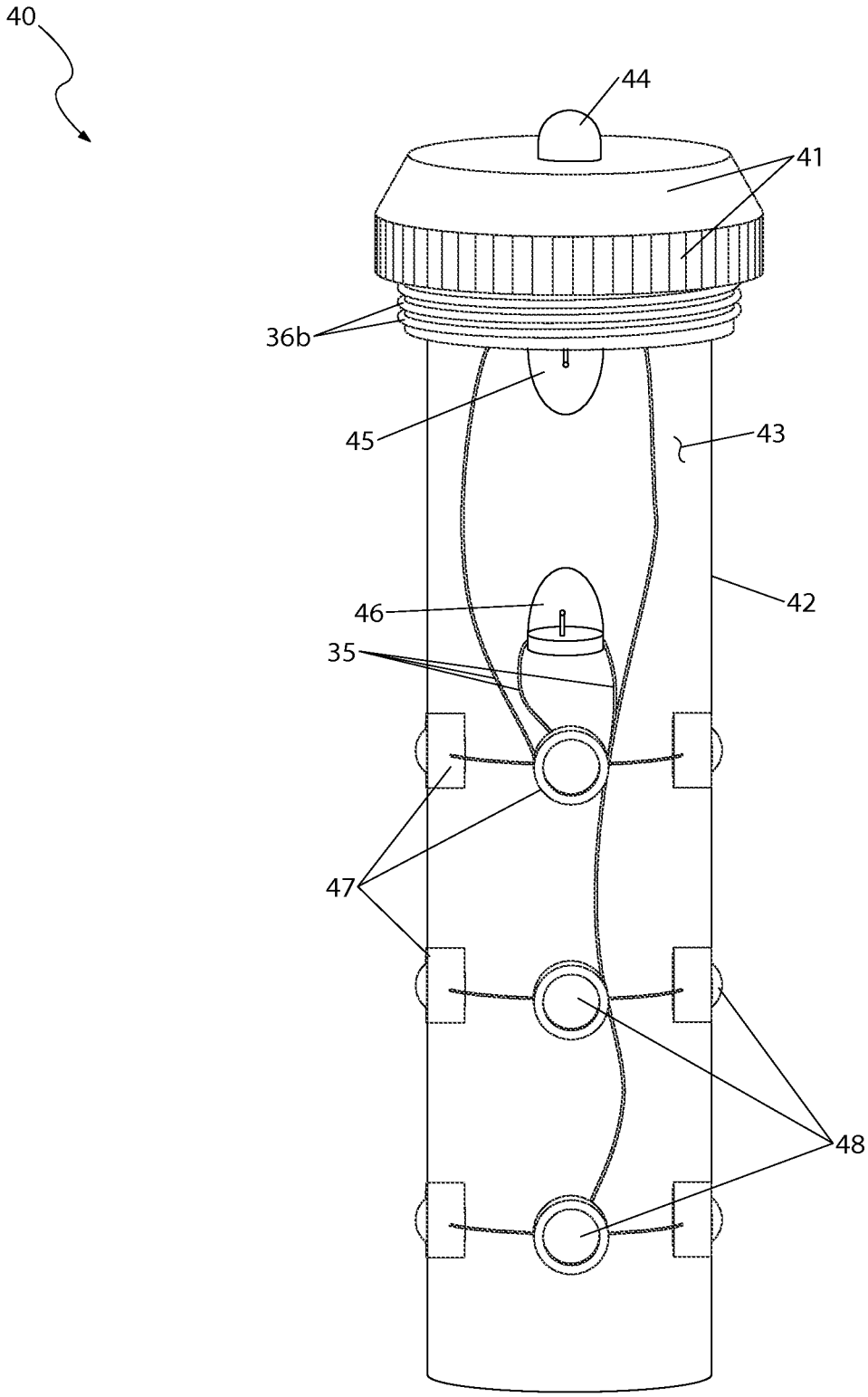
FIG. 5*b* is a perspective view of the lantern 40, according to a preferred embodiment of the present invention; and, FIG. 6 is an electrical block diagram of the combined flashlight and lantern 10, according to a preferred embodiment of the present invention.

Referring now to FIG. 4, a section view of the apparatus 10 taken along line A-A (see FIG. 3), FIG. 5*a*, a cut-away view of an upper portion of the flashlight 20, and FIG. 5*b*, a perspective view of the lantern 40, according to the preferred embodiment of the present invention, are disclosed. The lantern 40 is depicted in FIG. 5*b* as being removed from the barrel 24 for illustration purposes only it is known that the user should not remove said lantern 40 from said barrel 24. Side surfaces of a barrel interior portion 29 comprise a plurality of contact indentations 27 which are attached to an indentation routing layer 28. The indentation routing layer 28 is integral to the inner surface of the barrel 24, used to route wiring 35, and is preferably fabricated from a nonconductive material such as plastic or rubber. Although it is known that in lieu of utilizing the indentation routing layer 28 and wiring 35 a printed circuit board and traces may be utilized without limiting the scope of the apparatus 10. The contact indentations 27 are comprised of circular concave-shaped bodies which are preferably fabricated from stainless steel, brass, or a similar conductive material. The contact indentations 27 are interconnected to electrical wiring 35 which is routed from the batteries 30 through the indentation routing layer 28 to each contact indentation 27 to provide electrical current. The contacts indentations 27 are arranged by three (3) equally spaced rows orientated vertically, each having four (4) equally spaced contacts orientated in a radial pattern upon the barrel interior portion 29. Each row of contact indentations 27 provides either a positively charged current or a negatively charged current.

The contact indentations 27 align with a respective ball bearing 48 located upon the lantern 40. The ball bearings 48 are partially exposed to an exterior of the lantern 40 which also exposes them to the indentation routing layer 28 and enables said ball bearings 48 to engage into the contact indentations 27 which provides current to said lantern 40. The ball bearings 48 are arranged by three (3) equally spaced rows orientated vertically, each having four (4) equally spaced contacts orientated in a radial pattern upon the interior lantern structure 43. Each ball bearing 48 is secured within a frame 47 which is integrally molded into the lantern structure 42. The ball bearings 48 are spring-loaded within each respective frame 47 via a spring 49 which enables said lantern 40 to be slid into position with each ball bearing 48 engaged within a respective contact indentation 27. As the lantern 40 is pulled upwardly each ball bearing 48 is depressed within each frame 47 until a contact indentation 27 is aligned with said ball bearing 48, thereby enabling said ball bearing 48 to release into said respective contact indentation 27. Each row of the frames 27 are interconnected via interconnecting each spring 49 with wiring 35. This enables current from the batteries 30 to be routed through the contact indentations 27, into each ball bearing 48, and spring 49. This current is then utilized to illuminate a first lantern lamp 45 or a second lantern lamp 46 which are manipulated with the lantern switch 44.

Referring now to FIG. 6, an electrical block diagram of the apparatus 10, according to the preferred embodiment of the present invention, is disclosed. Current from the batteries 30 is sent to the flashlight switch 25 which manipulates the flashlight lamp 26 is a common manner. Once the lantern 40 is pulled upwardly into position with the contact indentations 27 aligned with the respective ball bearings 48 current from the batteries 30 is also sent to the lantern switch 44. It is known that the flashlight lamp 26 and lantern lamps 45, 46 may be utilized simultaneously as desired by the user. The lantern switch 44 preferably includes internal circuitry which enables said switch to cycle through various lantern lamp 45, 46 settings. The first lantern lamp 45 is located at an upper portion of the lantern 40 and the second lantern lamp 46 is located below said first lantern lamp 45 within said lantern 40 as to enable said lantern lamps 45, 46 to be visible when said lantern 40 is open. The lantern lamps 45, 46 are preferably either different style lamps or manipulated via the circuitry. These settings will include: click the lantern switch 44 once to illuminate a low lit first lantern lamp 45, click the lantern switch 44 twice to illuminate the second lantern lamp 46, click the lantern switch 44 thrice to illuminate an amber colored first lantern lamp 45, click the lantern switch 44 four (4) times to enable the second lantern lamp 45 to flash, and click the five (5) times to deactivate the lantern lamps 45, 46. Although it is known that other settings may be utilized without limiting the scope of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 3.

The method of installing and utilizing the flashlight 20 may be achieved by performing the following steps: acquiring the apparatus 10; removing the lens portion 21 from the head 23 via the threaded attachment 36 to replace or add batteries 30 as desired; replacing the lens portion 21 to the head 23; grasping the apparatus 10 by the barrel 24 and aiming the flashlight 20 to a desired area; depressing the flashlight switch 25 to send current from the batteries 30 to illuminate the flashlight lamp 26; utilizing as desired, and depressing the flashlight switch 25 to deactivate the flashlight lamp 26.

The method of installing and utilizing the lantern 40 may be achieved by performing the following steps: acquiring the apparatus 10; placing the apparatus 10 upright on a level surface with the lens portion 21 against said level surface; partially removing the lantern 40 from the barrel 24 via disengaging the threaded attachment 36 upon the tail cap 41 from the barrel 24; pulling the lantern 40 upwards and enabling the ball bearings 48 to slide against the indentation routing layer 28 until said ball bearings 48 engage the respective contact indentations 27; enabling current to be routed through the indentation routing layer 28 via wiring 35 to the contact indentations 27, into the ball bearings 48 and spring 49 and to the lantern switch 44; utilizing the lantern switch 44 to illuminate the lantern lamps 45, 46 as desired; utilizing the flashlight 20 as desired as abovementioned; deactivating the lantern lamps 45, 46 with the lantern switch 44 as desired; pushing the lantern 40 into the barrel 24 as desired and disengaging the ball bearings 48 from the contact indentations 27; and, engaging the threaded attachment 36 to secure the lantern 40 to the barrel 24.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A combined flashlight and lantern for creating various directions of illumination, said combined flashlight and lantern comprising:

a flashlight having a power source; and, a lantern slidably positioned within a length of said flashlight;

wherein said flashlight creates a unidirectional illumination and said lantern creates an omni-directional illumination; and, wherein said lantern is in electrical communication with said power source of said flashlight after said lantern is partially exposed exterior of said flashlight.

2. The combined flashlight and lantern of claim 1, wherein said flashlight and said lantern are simultaneously illuminated after said lantern is exposed exterior of said flashlight.

3. The combined flashlight and lantern of claim 1, wherein an exterior upper surface of said lantern is removably attached to an interior upper surface of said barrel.

4. The combined flashlight and lantern of claim 1, wherein said lantern comprises:

a transparent structure having a tail cap attached thereto, wherein a top surface of said tail cap comprises a lantern switch;

a plurality of lantern lamps located within transparent structure and communicatively coupled to said lantern switch located within the interior lantern structure; and, a plurality of spring-loaded ball bearings located on an exterior surface of said transparent structure.

5. The combined flashlight and lantern of claim 4, wherein said flashlight comprises: a barrel containing said lantern therein, said barrel including:

an inner surface provided with a non-conductive indentation routing layer; and, a plurality of conductive contact indentations attached to said indentation routing layer, said conductive contact indentations being electrically connected to said power source of said flashlight;

wherein said conductive contacts indentations are arranged in a plurality of spaced rows orientated vertically within said barrel, wherein each of said rows contains a plurality of said conductive contact indentations; and, wherein said conductive contact indentations are aligned with said ball bearings respectively.

6. The combined flashlight and lantern of claim 5, wherein, as said lantern is pulled upwardly within said barrel, said ball bearings are depressed and thereby aligned with said conductive contact indentations;

wherein said ball bearings are electrically coupled to said first and second lantern lamps and thereby direct power thereto when said ball bearings are aligned with said conductive contact indentations.

7. The combined flashlight and lantern of claim 5, wherein, once said lantern is pulled upwardly out from said barrel, said conductive contact indentations become aligned with said ball bearings and thereby transmit current from said flashlight power source to said lantern switch.

8. A combined flashlight and lantern for creating various directions of illumination, said combined flashlight and lantern comprising:

a flashlight having a power source contained therein; and, a lantern slidably positioned within a longitudinal length of said flashlight;

wherein said flashlight creates a unidirectional illumination and said lantern creates an omni-directional illumination; and, wherein said lantern is in electrical communication with said power source of said flashlight after said lantern is partially exposed exterior of said flashlight.

9. The combined flashlight and lantern of claim 8, wherein said flashlight and said lantern are simultaneously illuminated after said lantern is exposed exterior of said flashlight.

10. The combined flashlight and lantern of claim 8, wherein an exterior upper surface of said lantern is removably attached to an interior upper surface of said barrel.

11. The combined flashlight and lantern of claim 8, wherein said lantern comprises:

a transparent structure having a tail cap attached thereto, wherein a top surface of said tail cap comprises a lantern switch;

a plurality of lantern lamps located within transparent structure and communicatively coupled to said lantern switch located within the interior lantern structure; and, a plurality of spring-loaded ball bearings located on an exterior surface of said transparent structure.

12. The combined flashlight and lantern of claim 11, wherein said flashlight comprises: a barrel containing said lantern therein, said barrel including:

an inner surface provided with a non-conductive indentation routing layer; and, a plurality of conductive contact indentations attached to said indentation routing layer, said conductive contact indentations being electrically connected to said power source of said flashlight;

wherein said conductive contacts indentations are arranged in a plurality of spaced rows orientated vertically within said barrel, wherein each of said rows contains a plurality of said conductive contact indentations; and, wherein said conductive contact indentations are aligned with said ball bearings respectively.

13. The combined flashlight and lantern of claim 12, wherein, as said lantern is pulled upwardly within said barrel, said ball bearings are depressed and thereby aligned with said conductive contact indentations;

wherein said ball bearings are electrically coupled to said first and second lantern lamps and thereby direct power thereto when said ball bearings are aligned with said conductive contact indentations.

14. The combined flashlight and lantern of claim 12, wherein, once said lantern is pulled upwardly out from said barrel, said conductive contact indentations become aligned with said ball bearings and thereby transmit current from said flashlight power source to said lantern switch.

15. A method of utilizing a combined flashlight and lantern for creating various directions of illumination, said method comprising the chronological steps of:

providing a flashlight having a power source contained therein;

providing and slidably positioning a lantern within a longitudinal length of said flashlight;

partially exposing said lantern exterior of said flashlight and thereby creating an electrical communication between said lantern and said power source of said flashlight; and, said flashlight creating a unidirectional illumination and said lantern creating an omni-directional illumination.

* * * * *